US006769413B2

(12) United States Patent
Ishimoto

(10) Patent No.: US 6,769,413 B2
(45) Date of Patent: Aug. 3, 2004

(54) FUEL INJECTION PUMP

(75) Inventor: Masayori Ishimoto, Higashimatsuyama (JP)

(73) Assignee: Bosch Automotive Systems Corporation, Tokyo (JP)

( * ) Notice: Subject to any disclaimer, the term of this patent is extended or adjusted under 35 U.S.C. 154(b) by 1 day.

(21) Appl. No.: 10/182,574

(22) PCT Filed: Jan. 30, 2001

(86) PCT No.: PCT/JP01/00600

§ 371 (c)(1),
(2), (4) Date: Jul. 31, 2002

(87) PCT Pub. No.: WO01/57388

PCT Pub. Date: Aug. 9, 2001

(65) Prior Publication Data

US 2003/0012660 A1 Jan. 16, 2003

(30) Foreign Application Priority Data

Jan. 31, 2000 (JP) ..... 2000-22339

(51) Int. Cl.[7] ..... F02M 37/04

(52) U.S. Cl. ..... 123/509; 123/495; 123/198 C; 417/206

(58) Field of Search ..... 123/495, 509, 123/510, 198 C, 195 C, 195 A; 417/206

(56) References Cited

U.S. PATENT DOCUMENTS

| | | | | |
|---|---|---|---|---|
| 3,148,628 A | * | 9/1964 | Boudell | 91/506 |
| 3,181,468 A | * | 5/1965 | Roosa | 137/565.28 |
| 5,148,789 A | * | 9/1992 | Shiraishi et al. | 123/367 |
| 6,129,518 A | * | 10/2000 | Ricco | 417/206 |
| 6,330,876 B1 | * | 12/2001 | Spinnler et al. | 123/456 |

OTHER PUBLICATIONS

CD–ROM of the specification and drawings annexed to the request of Japanese Utility Model Application No. 15092/1993 (Laid–open No. 69356/1994) (Kabushiki Kaisha Kubota), Sep. 30, 1994, Full text; all drawings.

Microfilm of the specification and drawings annexed to the request of Japanese Utility Model Application No. 97569/1981 (Laid–open No. 2750/1983) (Sanyo Electric Co., Ltd.), Jan. 8, 1989, full text, drawings.

Microfilm of the specification and drawings annexed to the request of Japanese Utility Model Application No. 114599/1989 (Laid–open No. 54203/1991) (Suzuki K.K.), May 24, 1991, p. 2, lines 1–14, Fig. 5.

Microfilm of the specification and drawings annexed to the request of Japanese Utility Model Application No. 166345/1980 (Laid–open No. 89859/1982) (Yanmar Diesel Engine Co., Ltd.), Jun. 2, 1982, p. 3, lines 11–15, Fig. 1.

JP 2000–291502, A (Robert Bosch GmbH), Oct. 17, 2000, Full text, all drawings.

* cited by examiner

*Primary Examiner*—Carl S. Miller
(74) *Attorney, Agent, or Firm*—Wenderoth, Lind & Ponack L.L.P.

(57) ABSTRACT

A fuel injection pump includes a cam shaft (7) driving a plunger (4) and a feed pump (3) assembled therein for feeding fuel pressured by the plunger (4). A flange part (52) projecting radially is provided on the cam shaft (7), an internal gear (41) transmits a power to the feed pump (7), and a housing member (8*c*) rotatably supports the cam shaft (7) on the free end opposite to the end part of the driven side of the cam shaft (7). A housing member (8*c*) rotatably supporting the cam shaft (7) through a radial bearing (12) is held between the flange part (52) and the internal gear (41) so as to allow adjustment of the axial position of the cam shaft (7), so that adjustment of the axial position of the cam shaft is substituted for the existing member assembled into the pump. Thus, an axial gap due to a deterioration of durability of the bearing is eliminated to be adjusted so as to facilitate the assembly, reduce the number of parts, and reduce the size of the injection pump.

7 Claims, 5 Drawing Sheets

FUEL INJECTION PUMP

TECHNICAL FIELD

The present invention relates to a fuel injection pump that supplies fuel to an internal combustion engines. More specifically, it relates to a fuel injection pump having plungers and a cam shaft which is rotatably supported via radial bearings and drives the plungers, with a feed pump for delivering the fuel having been pressurized by the plungers installed therein.

BACKGROUND ART

The cam shaft of a fuel injection pump in the related art is supported at a bearing housing secured at a pump housing by utilizing a tapered roller bearing having a tapered roller constituting the rolling element or the like, so as to enable an accurate shim adjustment to set the clearance along the axial direction. Normally, the housing is constituted of an aluminum alloy to achieve a reduction in weight, and the cam shaft is constituted of steel to achieve good wear resistance. For this reason, when the cam shaft and the housing become heated, the difference between their coefficients of thermal expansion results in an increase in the clearance along the direction of the axis of the cam shaft, which, in turn, causes play when force is applied along the axial direction. Such play gives rise to problems of failure to achieve accurate injection characteristics and noise. Japanese Unexamined Patent Publication No. S 62-26372 and Japanese Unexamined Patent Publication No. H 2-42173, for instance, propose cam shaft supporting structures addressing these problems.

The first publication discloses a structure having a thrust bearing for the cam shaft formed as a fixed bearing that functions along the two axes, and a radial bearing formed as a movable bearing. More specifically, it discloses a structure achieved by forming the radial bearing as a cylindrical roller bearing provided inside a bearing cover so as to allow play of the cam shaft along the axial direction and by forming the axial bearing as a bearing plate. The axial bearing, together with a bearing cover, is tightly secured to the pump housing with screws with its internal circumferential edge connected inside a ring groove formed at the cam shaft. Another structure is achieved by forming the radial bearing as a cylindrical roller bearing provided within a bearing cover in a similar manner, and forming the bearing as a bearing having a bearing cover connected in a ring groove formed by the gap between an end surface of the cam shaft and a nut that screws into the end surface via a bearing plate.

These structures allow the cam shaft to be supported individually along the axial direction and along the radial direction so as to eliminate the need to use a tapered roller bearing.

In addition, the second publication discloses a structure achieved by providing a thrust bearing secured to the housing between two cams so as to achieve an accurate support while minimizing the wear of the bearings in a pump having a large number of cylinders requiring that the cam shaft has a large length. This structure, too, achieves an advantage of supporting the cam shaft individually along the axial direction and along the radial direction.

However, in the structures disclosed in the first publication, the position of the cam shaft along the axial direction is regulated by connecting the race member of the thrust bearing in the ring groove of the cam shaft on one side and linking the race member to the pump housing on the other side so as not to allow any movement of the race member on the other side. In the structure disclosed in the second publication, the axial position is adjusted by providing a thrust slide bearing secured to the housing. Since the position of the cam shaft along the axial direction is regulated by providing a slide bearing formed as a separate member in any of these structures, the number of required parts is bound to be large and, at the same time, the clearance along the axial direction must be adjusted in conformance to the extent to which the thrust bearing has become worn. In addition, since the slide bearing formed as a separate member must be provided along the axis of the cam shaft, the length of the cam shaft along the axis cannot readily be reduced, which presents a hindrance to achieving miniaturization of the injection pump. Accordingly, an object of the present invention is to provide a fuel injection pump that facilitates the assembly process, achieves a reduction in the number of required parts, and allows miniaturization by utilizing an existing member mounted at the pump instead of a separate bearing member for regulating the position of the cam shaft along the axial direction and eliminating the need for adjusting the gap along the axial direction which would otherwise be required to be adjusted in conformance to the extent to which the bearing has become worn.

SUMMARY OF THE INVENTION

An adoption of the present invention in practical application is realized as a result of the research and development conducted by the inventor based upon the concept that since a standard fuel injection pump includes a feed pump for feeding fuel pressurized by the plungers as an integrated part of the fuel injection pump assembly and the feed pump is driven by the cam shaft, the axial bearing formed as a separate member can be eliminated by regulating the position of the cam shaft along the axial direction with the existing component.

Namely, the fuel injection pump according to the present invention has plungers and a cam shaft that is rotatably supported via a radial bearing along the radial direction and drives the plungers with a feed pump for feeding fuel pressurized by the plungers installed therein. A flange part projects along the radial direction at the cam shaft, and a power transmission member that transmits a motive force to the feed pump is provided at an end of the cam shaft on a side opposite from the end of the cam shaft which is driven. The portion that rotatably supports the cam shaft via the radial bearing is held between the flange part and the power transmission member to adjust the axial position of the cam shaft.

Since the portion that supports the cam shaft along the radial direction is held between the flange part formed at the cam shaft and the power transmission member that is provided at the end on the opposite side from the end on the driven side and transmits the motive force to the feed pump, and since the axial position of the cam shaft is adjusted through this structure, the need for providing a special member for regulating the axial position is eliminated. As a result, since the axial position adjustment can be achieved without having to employ a thrust bearing, it becomes unnecessary to adjust the clearance in conformance to the extent of wear of the thrust bearing. At the same time, as the axial position of the cam shaft is regulated in reference to the portion held between the flange part and the power transmission member, an accurate support is achieved along the axial direction at all times and is unaffected by any changes in the temperature. In addition, since the axial position is regulated by utilizing the existing member provided to drive the feed pump instead of providing a special member along the axial direction, the absence of such a special member along the axial direction allows the dimension along the axial dimension to be reduced.

In this structure, the radial bearing at the cam shaft may be formed of a cylindrical roller bearing which uses a cylindrical roller as a rolling element, or the radial bearing may be formed of a plane bearing. In the latter case, the dimension of the cam shaft along the radial direction, too, can be reduced. At the same time, the process for assembling the cam shaft is facilitated, thereby allowing the injection pump to be manufactured at low cost.

Furthermore, since the pump housing is normally formed of a separate housing member, this housing member may be used as the portion that rotatably supports the cam shaft via the radial bearing.

DETAILED DESCRIPTION OF THE INVENTION

Figure 1:
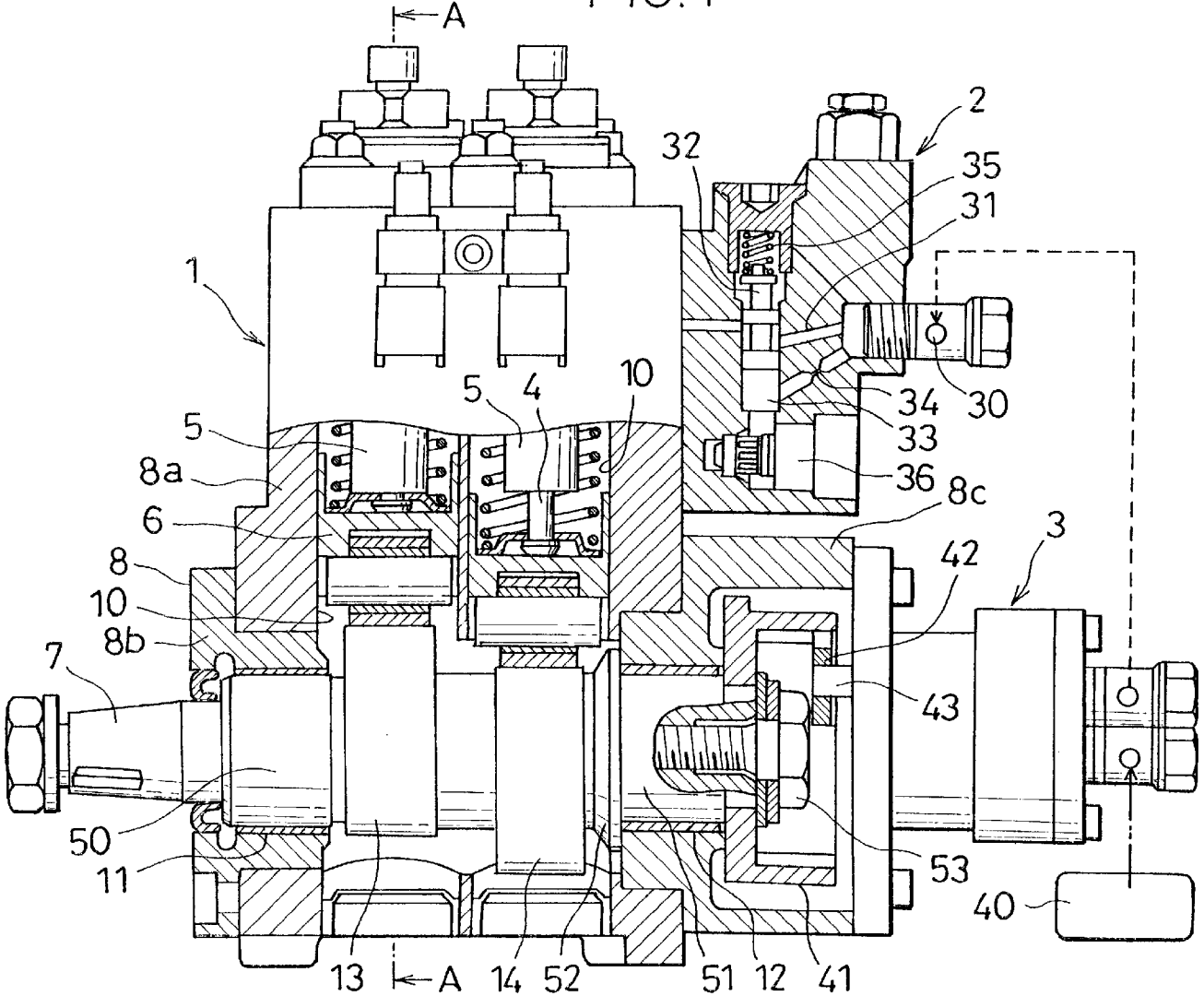
FIG. 1 is a partially notched sectional view of the fuel injection pump, according to the present invention.
Figure 2:
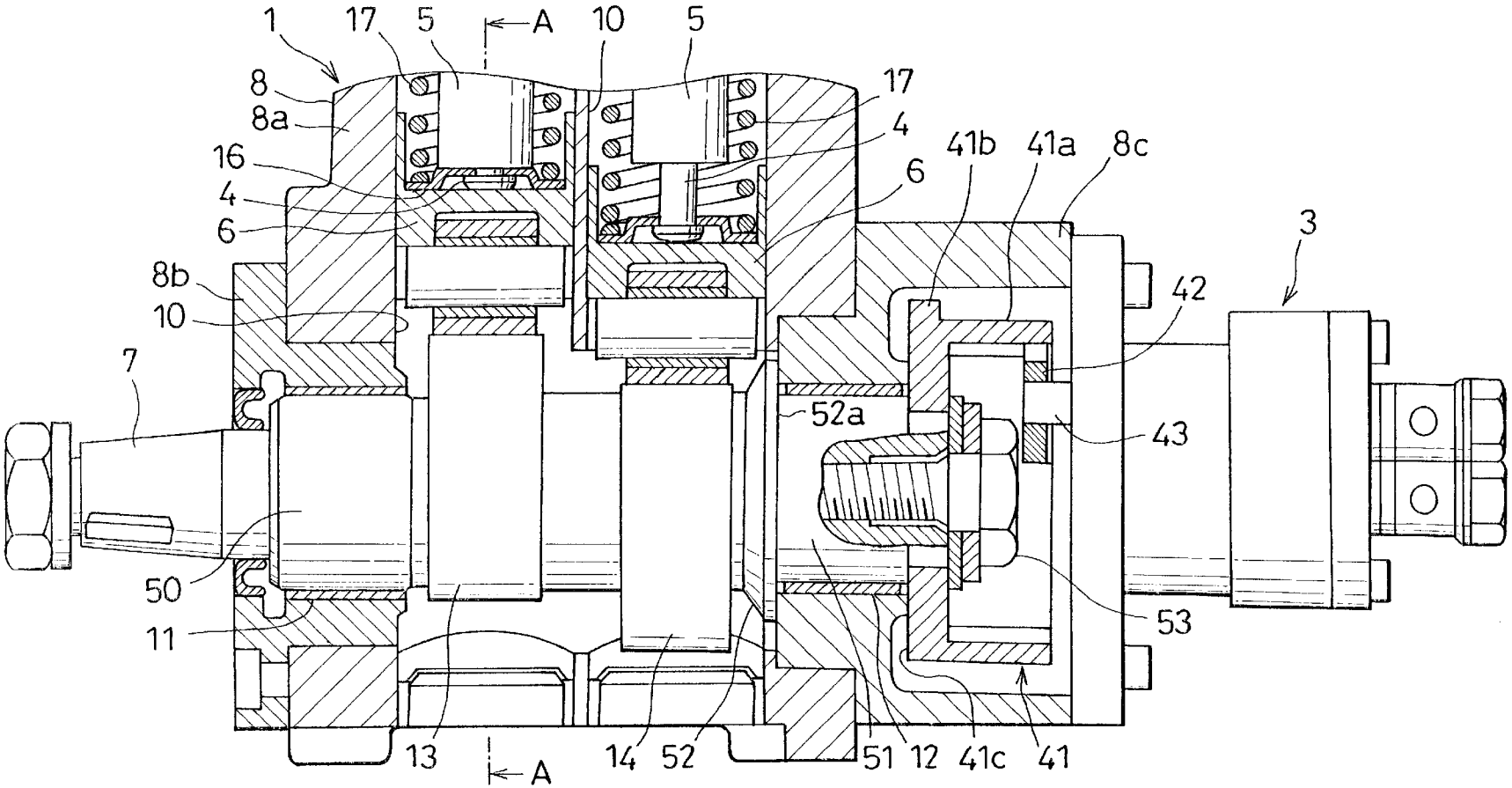
FIG. 2 is an enlarged sectional view of the cam shaft and the feed pump in the fuel injection pump shown in FIG. 1.
Figure 3:
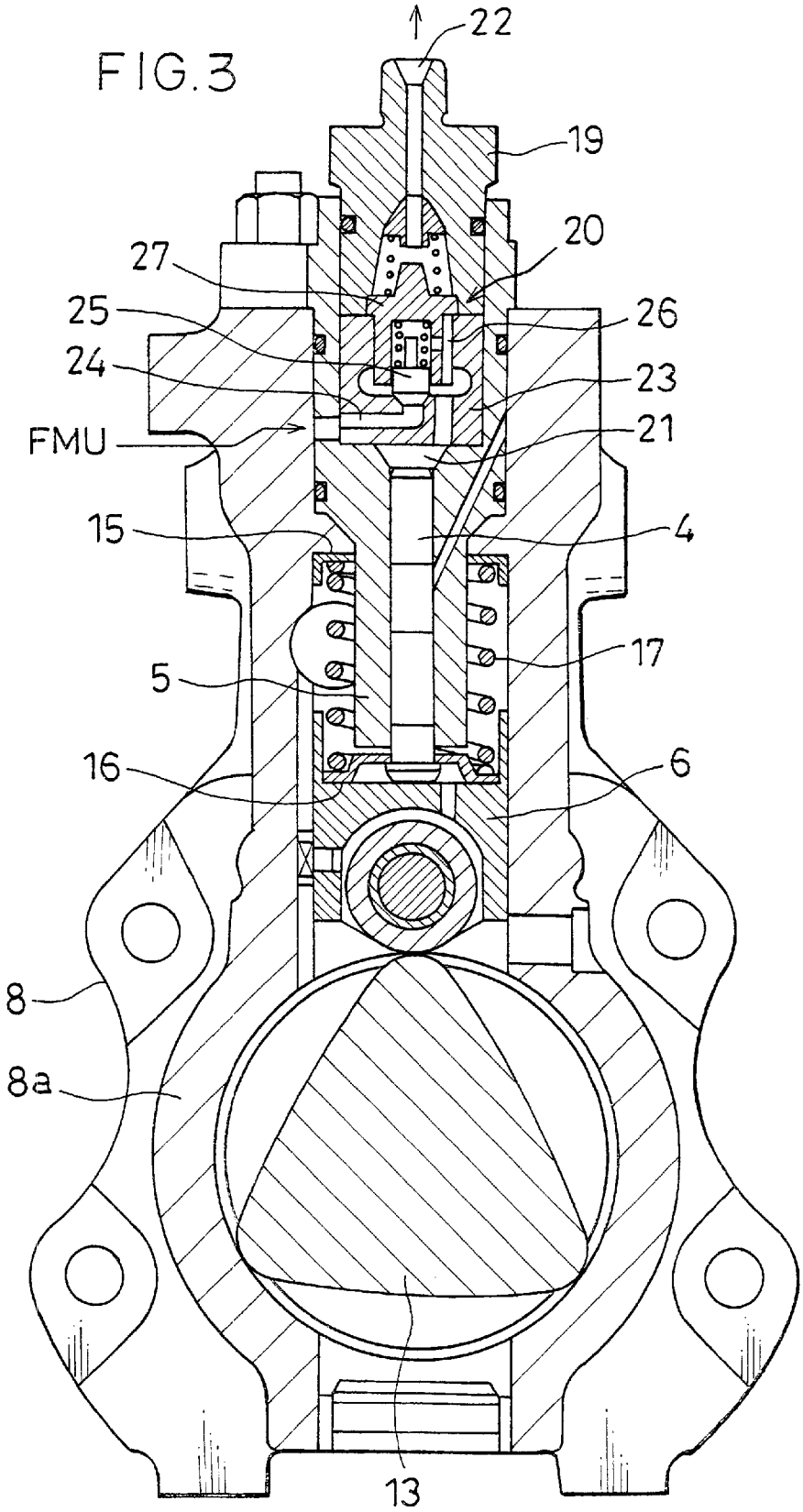
FIG. 3 is a sectional view taken along A—A in FIG. 1 and FIG. 2.

The following is an explanation of an embodiment of the present invention, given with reference to the drawings. FIGS. 1 through 3 show a fuel injection pump formed by assembling a supply pump 1, a fuel metering unit (FMU) 2 and a feed pump 3.

The supply pump 1 comprises plungers 4, plunger barrels 5, tappets 6 and a cam shaft 7, with the cam shaft 7 supported at a pump housing 8 and one end of the cam shaft projecting out through the pump housing 8 to receive drive torque from an engine (not shown) so that the cam shaft 7 rotates in synchronization with the engine.

The pump housing 8 includes a housing member 8*a* having longitudinal holes 10 in which the plunger barrels 5 are fitted, and housing members 8*b* and 8*c* that are secured to the housing member 8*a* with bolts or the like and that rotatably hold the cam shaft 7 near the two ends thereof.

In this example, two longitudinal holes 10 are formed in the housing member 8*a*, and the plunger barrels 5 are each secured to the housing member 8*a* inside one of the longitudinal holes with the plungers 4 inserted in the plunger barrels 5 so as to move reciprocally within the plunger barrels.

In addition, the cam shaft 7 is supported by the housing members 8*b* and 8*c* near the two ends thereof via radial bearings 11 and 12 so as to allow play along the axial direction, and two drive cams 13 and 14 each provided for one of the plungers are formed on the cam shaft 7 between the radial bearings at phases offset from each other.

The lower ends of the plungers 4 are placed in contact with the drive cams 13 and 14 formed at the cam shaft 7 via the tappets 6, and springs 17 are each mounted between a spring receptacle 15 provided at the housing member 8*a* and a spring receptacle 16 provided at the bottom of the corresponding plunger 4 so that when the cam shaft 7 rotates, the plungers 4 are allowed to engage in reciprocal movement along the contours of the drive cams 13 and 14 in cooperation with the springs 17.

At the top of each of the plunger barrels 5, an IO valve (inlet) /outlet valve) 20 mounted between the plunger barrel 5 and a delivery valve holder 19 is provided. A plunger chamber 21 is formed between the IO valve 20 and each of the plungers 4, and a fuel outlet 22 formed at the delivery valve holder 19 is set above the IO valve 20.

Each IO valve 20 in this structure, which supplies the fuel fed from the fuel metering unit (FMU) 2 that is to be detailed later to the plunger chambers 21 and sends out the fuel having been compressed by the plungers 4 through the fuel outlet 22 so that the fuel does not flow back to the FMU 2, includes a valve body 23 mounted at an upper portion of the plunger barrels 5, an inlet valve 25 having a first end communicating with the FMU 2 while the other (second) end thereof opens/closes a fuel passage 24 that in formed at the valve body 23 and communicates with the plunger chambers 21. The inlet valve 25 imparts a constant force to hold the fuel passage 24 closed by utilizing the force applied by the FMU 2 in resistance against the fuel pressure. Outlet valve 27 has a first end communicating with the plunger chamber 21 while the other (second) end thereof opens/closes a fuel passage 26 communicating with the fuel outlet 22, and imparts a constant force to hold the fuel passage 26 closed by utilizing the force applied from the plunger chambers 21 in resistance against the fuel pressure. As the plunger 4 descends, the outlet valve 27 closes, thereby allowing the fuel from the FMU 2 to push up the inlet valves 25 and thus causing the fuel to flow into the plunger chambers 21. As the plunger 4 ascends, the pressurized fuel closes the inlet valve 25 to push up the outlet valve 27 thereby forcibly feeding the fuel through the fuel outlet 22.

In the fuel metering unit (FMU) 2, which feeds the fuel fed from the feed pump 3 that is to be detailed later to the IO valve 20 after adjusting the quantity of the fuel so as to achieve the fuel pressure level required by the engine, throttle valves 32 are each provided in the middle of a fuel passage 31 through which the fuel fed from the feed pump 3 is guided to the IO valve 20 from a fuel inlet 30. The fuel fed from the feed pump 3 is supplied via an orifice 34 to a pressure chamber 33 provided at one end of the throttle valve 32. The throttle valve 32 stops at the position in which the pressure at the pressure chamber 33 and the spring force of a spring 35 provided at the other end of the throttle valve 32 are in balance, and the pressure in the pressure chamber 33 is adjusted by utilizing an electromagnetic valve 36 controlled by an electronic control unit (ECU) (not shown). Thus, the constriction of the fuel passage 31 is controlled to adjust the quantity of fuel supplied to the IO valve 20.

Figure 4:
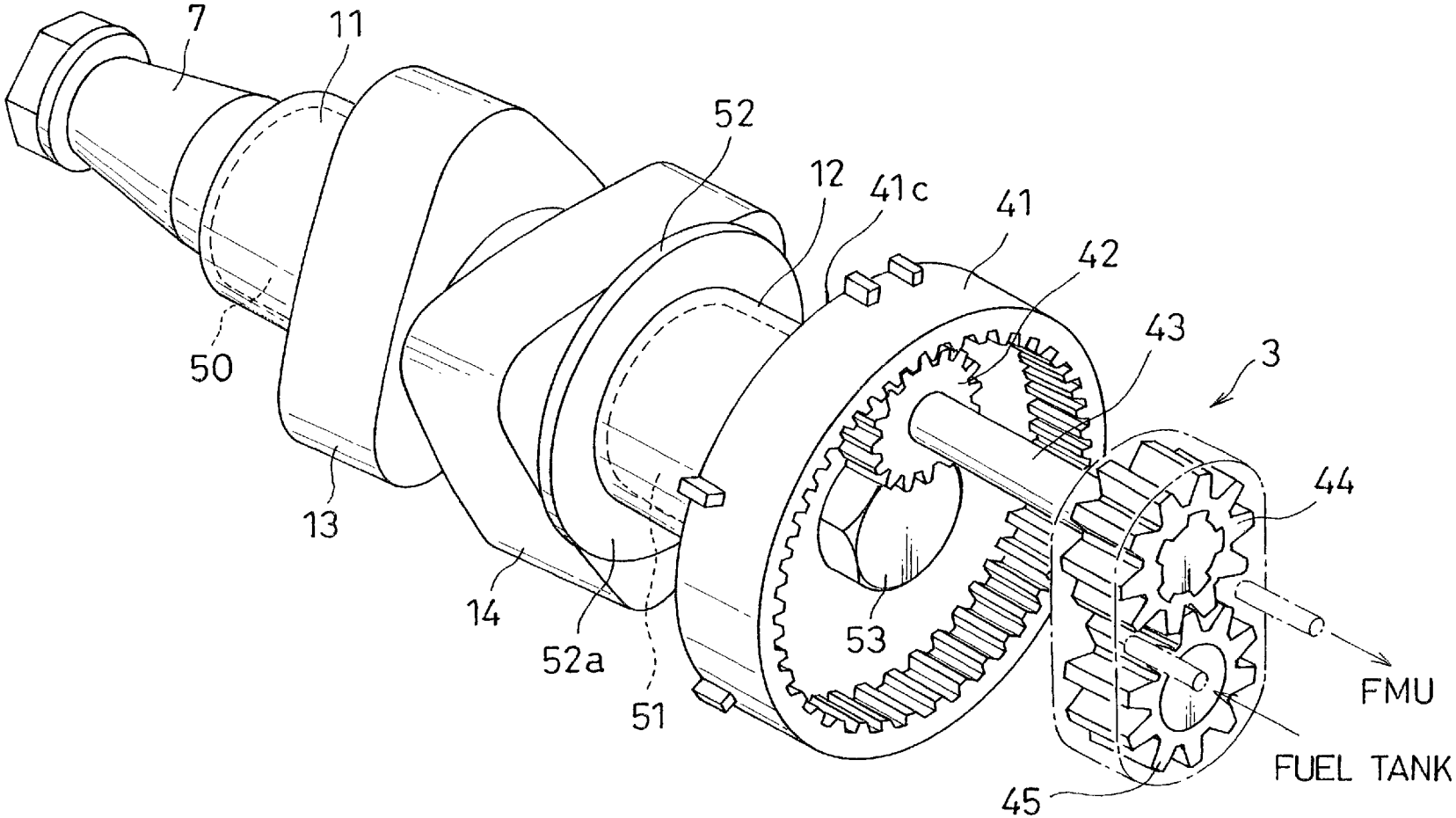
FIG. 4 is a perspective view of the cam shaft and the feed pump employed in the fuel injection pump according to the present invention.

The feed pump 3, which feeds the fuel drawn up from a fuel tank 40 to the fuel metering unit (FMU) 2, is mounted with a bolt or the like so as to close off the opening of the housing member 8*c* constituting the pump housing 8. As shown in FIG. 4, the feed pump is an external gear pump to which a motive force is transmitted from an internal gear 41, which is secured to the end of the cam shaft 7 opposite from the driven end of the cam shaft 7, and rotates together with the cam shaft 7. Namely, the feed pump 3 comprises a drive gear 42 which interlocks with the internal gear 41, a main gear 44 which is linked to the drive gear 42 by a shaft 43, and a slave gear 45 that interlocks with the main gear. As the rotation of the cam shaft 7 causes the main gear 44 and the slave gear 45 to rotate, the gear pump formed of the main gear 44 and the slave gear 45 draws in the fuel from the fuel tank 40. Thus, the fuel oil is supplied to the fuel metering unit (FMU) 2 via a fuel filter (46: shown in FIG. 5).

Figure 5:
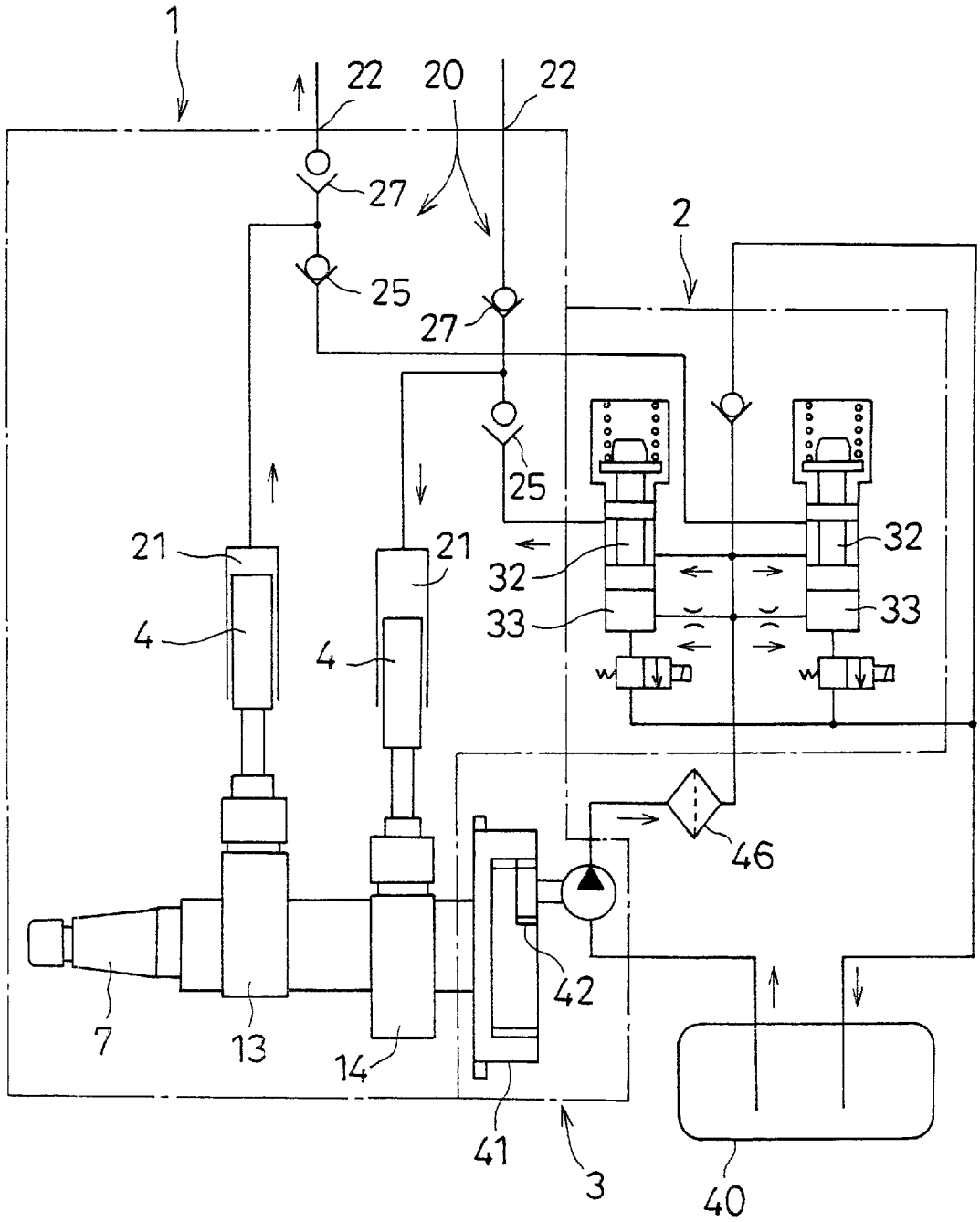
FIG. 5 is a system operation diagram of the fuel injection pump according to the present invention.

Thus, the fuel injection pump described above assumes an overall structure illustrated in FIG. 5, in which the fuel is supplied from the fuel tank 40 through the feed pump 3 to the fuel metering unit (FMU) 2 where the quantity of fuel oil to be supplied to each of the plunger chambers 21 of the supply pump 1 is adjusted. Then the fuel is supplied to the plunger chambers 21 via the IO valve to forcibly feed the fuel oil alternately pressurized by the two plungers 4 through the fuel outlet 22.

In this fuel injection pump, the radial position of the cam shaft is regulated by the radial bearings 11 and 12, which are each constituted as a cylindrical plane bearing externally fitted on the cam shaft 7 so as to be allowed to slide against (i.e., with respect to) the cam shaft 7. At the circumferential surface of the cam shaft 7, bearing surfaces 50 and 51 are formed as plane bearing receptacles over the ranges in which the plane bearings are set. The axial position of the cam shaft 7 is regulated by a means for axial position regulation described below.

The means for axial position regulation is achieved by providing a flange part 52 projecting in the radial direction (with respect to cam shaft 7) further frontward relative to the bearing surface 51 of the cam shaft 7 formed on the end opposite from the driven end. In other words, the flange part 52 is located between the bearing surface 51 and the drive cam 14. In addition, the housing member 8*c* supporting the cam shaft 7 via the radial bearing 12 is held between the flange part 52 and the internal gear 41 provided further toward the end relative to the bearing surface 51. In other words, the internal gear 41 is secured to the end of the cam shaft 7 on the opposite end from the driven end (i.e., the free end), while assuring enough clearance so that the rotation of the cam shaft is not hindered.

In this structure, the width along the axial direction of the housing member 8*c* that is held between the flange part and the internal gear roughly matches the width of the bearing surface 51 located along the axial direction. Thus, it also roughly matches the width of the radial bearing 12 along the axial direction. Since this width is very small compared to the entire length of the cam shaft 7, it remains virtually unaffected by thermal expansion. In addition, the flange part 52 in this example is formed as an integrated part of the external circumferential surface of the cam shaft 7 over the entire circumference, and an end surface 52*a* placed in contact with the housing member 8*c* is formed perpendicular to the axial center of the cam shaft 7. The internal gear 41 secured to the cam shaft 7 to transmit the motive force to the feed pump 3, on the other hand, assumes a cylindrical shape with a bottom, with teeth formed at the inner surface of a cylindrical portion 41*a* along the circumferential direction so as to set the curved surfaces of the tips of the teeth further inward relative to the curved surfaces of the bases of the teeth by turning the opening side toward the feed pump. The bottom 41*b* is tightly secured to the end surface of the cam shaft 7 on the opposite end from the driven end by a bolt 53 and an end surface 41*c* of the bottom 41*c* which is in contact with the housing member 8*c* formed perpendicular to the axial center of the cam shaft 7.

Namely, the axial position of the cam shaft 7 is regulated by slidably holding the housing member 8*c* between the end surface 52*a* of the flange part 52 formed on the cam shaft 7 and the end surface 41*c* of the power transmission member (41) that transmits motive force to the feed pump 3, instead of regulating the position of the cam shaft 7 along the thrust direction by providing a thrust bearing in the related art such as a slide bearing between the cam shaft 7 and the housing. Thus, the need to include a thrust bearing in the related art in the structure of the means for axial position regulation is eliminated.

By adopting this structure, the cam shaft 7 is supported along the axial direction at the free end opposite from the driven end on the driven driven. In addition, since its axial position is adjusted in reference to the supported end, play in the cam shaft along the axial direction is minimized. In other words, as the pump housing 8 and the cam shaft 7 expand to different degrees along the axis of the cam shaft 7 due to the difference between their coefficients of thermal expansion when the cam shaft 7 and the pump housing 8 become heated, the cam shaft 7 is supported by holding the housing member 8*c* at the free end opposite from the driven end. Thus, a relative shift occurring with regard to the positions of the housing and the cam shaft 7 as a result of thermal expansion is absorbed by the radial bearing 11 provided at the cam shaft 7 on the driven end, which tolerates play in the cam shaft 7 along the axial direction. In addition, since the axial position of the cam shaft itself is regulated by holding the portion that supports the cam shaft along the radial direction via the radial bearing 12 (i.e., by holding the housing member 8*c*), the support structure remains virtually unaffected by heat and, as a result, no play manifests along the axial direction.

Consequently, no heat-induced play occurs along the axis of the cam shaft 7 to result in a failure to achieve accurate injection characteristics or noise. In addition, the internal gear 41 and the drive gear 42 are allowed to interlock with each other with a high degree of accuracy at all times. Furthermore, since the thrust bearing employed in the related art is not utilized, it is not necessary to adjust the gap along the axial direction in conformance to the extent of wear of the thrust bearing, and a reduction in the number of parts constituting the injection pump is achieved. Moreover, the absence of any thrust bearing allows the length of the cam shaft 7 along the axial direction to be reduced, to achieve miniaturization of the injection pump.

Since the radial bearings 11 and 12 supporting the cam shaft along the radial direction are each formed of a plane bearing in the structure explained above, the cam shaft can be mounted at the pump housing with ease. Since the dimensions of the support structure along the radial direction can be reduced, the injection pump can be miniaturized. In addition, in the structure achieved in the present invention, the separate housing members 8*b* and 8*c* constituting the pump housing 8 are used as members for rotatably supporting the cam shaft 7 via the radial bearings 11 and 12 under normal circumstances. Thus, the housing member 8*c* is held between the flange part 52 and the power transmission member (the internal gear 41) which transmits the motive force to the feed pump 3, so that no major design modification of the injection pump is necessary.

Industrial Applicability

As described above, according to the present invention in which a flange part is formed at a cam shaft of an injection pump and a power transmission member is provided at the free end of the cam shaft opposite from the driven end on the driven side and transmits a motive force to the feed pump, and in which the portion supporting the cam shaft along the radial direction is held between the flange part and the power transmission member to regulate the axial position of the cam shaft, it is not necessary to provide a separate member for regulating the axial position. Since no thrust bearing is present, the need to adjust the clearance in conformance to the extent of wear of the thrust bearing is eliminated. Thus, as it is not necessary to implement a special process for positioning the cam shaft along the axial direction, the assembly process is simplified and a reduction in the production cost is achieved.

In addition, since the axial position of the cam shaft can be set in reference to the portion held between the flange part and the power transmission member without having to employ an axial bearing, the cam shaft is supported along the axial direction without readily becoming affected by heat to achieve an accurate support along the axial direction. Furthermore, instead of regulating the axial position by providing a special member, the existing member that transmits a motive force to the feed pump is utilized. As a result, the absence of a special member along the axial direction allows the length along the axial direction to be reduced, which, in turn, allows the injection pump to be miniaturized.

Moreover, by forming radial bearings at the cam shaft as plane bearings, the dimensions of the support structure along the radial can also be reduced to achieve further miniaturization of the injection pump. The cam shaft assembly process is also facilitated by forming the radial bearings as plane bearings, so that the injection pump can be manufactured at low cost.

It is to be noted that since a portion that rotatably supports the cam shaft via radial bearings is normally constituted of a separate housing member that constitutes the pump housing, this housing member may be held between the flange part formed at the cam shaft and the power transmission member that transmits a motive force to the feed pump. By adopting such a structure, it becomes unnecessary to greatly modify the design of the existing structural features.

What is claimed is:

1. A fuel injection pump comprising:

a housing having chambers formed therein;

plungers operable to reciprocate in said chambers;

a camshaft rotatably supported by said housing via a radial bearing, said camshaft having a drive end extending from said housing to receive rotation power, having a free end opposite said drive end, and having cams operable to rotate due to the rotation power received by said drive end so as to reciprocate said plungers in said chambers;

a feed pump for supplying fuel to said chambers;

a power transmission member detachably connected to said free end of said camshaft for transmitting a motive force from said camshaft to said feed pump, said power transmission member being arranged so as to contact a first side of said housing to thereby limit a position of said camshaft with respect to an axial direction of said camshaft; and a flange portion at said free end of said camshaft and arranged so as to contact a second side of said housing opposite said first side to thereby limit a position of said camshaft with respect to an axial direction of said camshaft.

2. The fuel injection pump of claim 1, wherein said feed pump comprises a gear pump having gears, and said power transmission member comprises an internal gear engaging a drive gear for rotating said gears of said gear pump.

3. The fuel injection pump of claim 1, wherein said radial bearing is located between said power transmission member and said flange portion.

4. The fuel injection pump of claim 3, wherein said flange portion is located between said radial bearing and said cams of said camshaft.

5. The fuel injection pump of claim 1, wherein said flange portion is located between said radial bearing and said cams of said camshaft.

6. The fuel injection pump of claim 1, wherein said flange portion is formed as an integrated portion of said camshaft and extends around an entire circumference of said camshaft.

7. The fuel injection pump of claim 1, wherein a surface of said flange portion for contacting said second surface of said housing is perpendicular to a longitudinal axis of said camshaft.

* * * * *